US010655560B2

(12) United States Patent
Sakata et al.

(10) Patent No.: US 10,655,560 B2
(45) Date of Patent: May 19, 2020

(54) CYLINDER HEAD

(71) Applicant: TOYOTA JIDOSHA KABUSHIKI KAISHA, Toyota-shi, Aichi-ken (JP)

(72) Inventors: Kunihiko Sakata, Nagakute (JP); Atsushi Komada, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/209,031

(22) Filed: Dec. 4, 2018

(65) Prior Publication Data

US 2019/0195167 A1 Jun. 27, 2019

(30) Foreign Application Priority Data

Dec. 22, 2017 (JP) ..... 2017-246170

(51) Int. Cl.

| | |
|---|---|
| ***F02F 1/42*** | (2006.01) |
| ***F01P 3/16*** | (2006.01) |
| ***F02F 1/38*** | (2006.01) |
| ***F02F 1/40*** | (2006.01) |
| ***F02F 1/24*** | (2006.01) |

(52) U.S. Cl.

CPC ..... *F02F 1/4285* (2013.01); *F01P 3/16* (2013.01); *F02F 1/242* (2013.01); *F02F 1/38* (2013.01); *F02F 1/40* (2013.01)

(58) Field of Classification Search

CPC .... F02F 1/4285; F02F 1/38; F02F 1/40; F01P 3/16

See application file for complete search history.

(56) References Cited

U.S. PATENT DOCUMENTS

| | | | | |
|---|---|---|---|---|
| 3,491,731 | A * | 1/1970 | Deutschmann | F01P 3/14 123/41.82 R |
| 4,083,333 | A * | 4/1978 | Rudert | F02F 1/242 123/41.82 R |
| 4,889,080 | A * | 12/1989 | Oguri | F02F 1/40 123/41.82 R |
| 2002/0124815 | A1* | 9/2002 | Ishiguro | F02F 1/242 123/41.82 R |
| 2013/0192546 | A1* | 8/2013 | Ruffing | F02F 1/40 123/41.76 |

FOREIGN PATENT DOCUMENTS

| | | |
|---|---|---|
| JP | 2003-056426 A | 2/2003 |
| JP | 2004-225582 A | 8/2004 |
| JP | 2013-015039 A | 1/2013 |
| JP | 2017-031890 A | 2/2017 |

* cited by examiner

*Primary Examiner* — Kevin A Lathers
(74) *Attorney, Agent, or Firm* — Oliff PLC

(57) ABSTRACT

A cylinder head comprises a cylinder head body. The cylinder head body has two intake ports placed on a first side of the cylinder head body with respect to the plug hole, and the two exhaust ports placed on a second side of the cylinder head body with respect to the plug hole. A water jacket of the cylinder head includes: an intake-port-to-intake-port passage portion communicating with the outside of the cylinder head and extending between the two intake ports; an exhaust-port-to-exhaust-port passage portion communicating with the outside of the cylinder head and extending between the two exhaust ports; and a central passage portion communicating with the intake-port-to-intake-port passage portion and the exhaust-port-to-exhaust-port passage portion, the central passage portion being formed so as to surround the plug hole.

6 Claims, 4 Drawing Sheets

CYLINDER HEAD

INCORPORATION BY REFERENCE

The disclosure of Japanese Patent Application No. 2017-246170 filed on Dec. 22, 2017 including the specification, drawings and abstract is incorporated herein by reference in its entirety.

BACKGROUND

1. Technical Field

The present disclosure relates to a cylinder head.

2. Description of Related Art

In a cylinder head described in Japanese Unexamined Patent Application Publication No. 2013-15039 (JP 2013-15039 A), a plug hole is provided for each of a plurality of cylinders of an internal combustion engine such that the plug hole penetrates through the cylinder head in the up-down direction (the axis direction of the cylinders). An ignition plug is passed through the plug hole and a part of the ignition plug on a distal side is exposed in the cylinder. In the cylinder head, one cylinder (one plug hole) is provided with two intake ports and two exhaust ports. The two intake ports and the two exhaust ports are placed so as to surround the plug hole, such that the two intake ports are placed on a first side from the plug hole and the two exhaust ports are placed on a second side from the plug hole.

The cylinder head is provided with a water jacket through which a coolant flows. The water jacket extends in a direction along which the cylinders are arranged inside the cylinder head as a whole. The coolant flows around the intake ports, around the exhaust ports, and around the plug holes in the direction along which the cylinders are arranged in the water jacket.

SUMMARY

In the cylinder head, a first side in the direction along which the cylinders are arranged corresponds to an upstream side in a coolant circulation direction. Accordingly, a first side of a region around the plug hole in the arrangement direction of the cylinders is easily cooled down, but a second side thereof in the direction along which the cylinders are arranged can be hardly cooled down. Accordingly, in the region around the plug hole, the cooling effect by the coolant is different between the first side and the second side in the direction along which the cylinders are arranged.

In order to solve the problem, a cylinder head includes a cylinder head body including a water jacket through which a coolant circulates and the water jacket is provided inside the cylinder head body. The cylinder head body has a plug hole penetrating through the cylinder head body and the plug hole is provided for each of a plurality of cylinders of an internal combustion engine such that an ignition plug is passed through the plug hole. The cylinder head body further has two intake ports and two exhaust ports per plug hole and the two intake ports and the two exhaust ports are provided inside the cylinder head body such that the two intake ports are placed on a first side of the cylinder head body in a short direction of the cylinder head body with respect to the plug hole and the two exhaust ports are placed on a second side of the cylinder head body in the short direction of the cylinder head body with respect to the plug hole. The water jacket includes an intake-port-to-intake-port passage portion, an exhaust-port-to-exhaust-port passage portion, a central passage portion, and a discharge passage portion. The intake-port-to-intake-port passage portion communicates with an outside of the cylinder head and extends between the two intake ports. The exhaust-port-to-exhaust-port passage portion communicates with the outside of the cylinder head and extends between the two exhaust ports. The central passage portion communicates with the intake-port-to-intake-port passage portion and the exhaust-port-to-exhaust-port passage portion. The central passage portion is formed so as to surround the plug hole. The discharge passage portion communicates with the central passage portion and extends toward the outside of the cylinder head.

In the above configuration, when the coolant is introduced into the intake-port-to-intake-port passage portion and the exhaust-port-to-exhaust-port passage portion from the outside of the cylinder head, the plug hole is cooled from the opposite sides, i.e., the intake port side and the exhaust port side. Accordingly, it is possible to restrain deviation in the cooling effect by the coolant around the plug hole.

In the cylinder head, a passage sectional area of the intake-port-to-intake-port passage portion may be smallest in an end, on the central passage portion side, of the intake-port-to-intake-port passage portion. A passage sectional area of the exhaust-port-to-exhaust-port passage portion may be smallest in an end, on the central passage portion side, of the exhaust-port-to-exhaust-port passage portion.

With the configuration, the flow rate of the coolant flowing from the intake-port-to-intake-port passage portion into the central passage portion can be increased at the end of the intake-port-to-intake-port passage portion. Further, the flow rate of the coolant flowing from the exhaust-port-to-exhaust-port passage portion into the central passage portion can be increased at the end of the exhaust-port-to-exhaust-port passage portion. This accordingly makes it possible to introduce the coolant into the central passage portion vigorously and to promote cooling around the plug hole.

In the cylinder head, an injection valve hole in which a fuel injection valve is inserted may be provided between the plug hole and the two intake ports so as to be adjacent to the plug hole. In an inner surface of the central passage portion, an inner peripheral surface extending in a circumferential direction of the plug hole may include an arcuate curved surface extending so as to surround the plug hole, and an overhanging surface overhanging toward the plug hole side from the curved surface. The overhanging surface may be placed between the plug hole and a corresponding one of the two exhaust ports.

In the above configuration, the plug hole and the injection valve hole are both placed in a limited region between the exhaust ports and the intake ports. Accordingly, a distance between the plug hole and the exhaust port tends to be short, so that it is difficult to secure a passage sectional area of a part of the central passage portion between the plug hole and the exhaust port. In the above configuration, while the inner peripheral surface of the central passage portion extends in the circumferential direction of the plug hole as a whole, the overhanging surface in the inner peripheral surface overhangs toward the plug hole side. That is, in a part, of the central passage portion, where the overhanging surface is formed, the passage expands toward the plug hole side. Since the overhanging surface is placed between the plug hole and the exhaust port, it is possible to secure a necessary passage sectional area in a part, of the central passage portion, between the plug hole and the exhaust port.

In the cylinder head, an injection valve hole in which a fuel injection valve is inserted may be provided between the plug hole and the two intake ports so as to be adjacent to the plug hole. The central passage portion may be formed so as to surround the plug hole and the injection valve hole. The central passage portion may include a projecting portion projecting toward a region between the plug hole and the injection valve hole.

In a case where the distance between the plug hole and the injection valve hole is very short, it is difficult to form a water jacket across the region between the plug hole and the injection valve hole. In this case, the region between the plug hole and the injection valve hole cannot be cooled, so that the region therebetween is easily filled with heat. In this regard, with the above configuration, even in a case where the distance between the plug hole and the injection valve hole is very short, the region around the plug hole can be cooled from the injection valve hole side. Further, the region around the injection valve hole can be cooled from the plug hole side. Accordingly, it is possible to restrain the region between the plug hole and the injection valve hole from being filled with heat.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
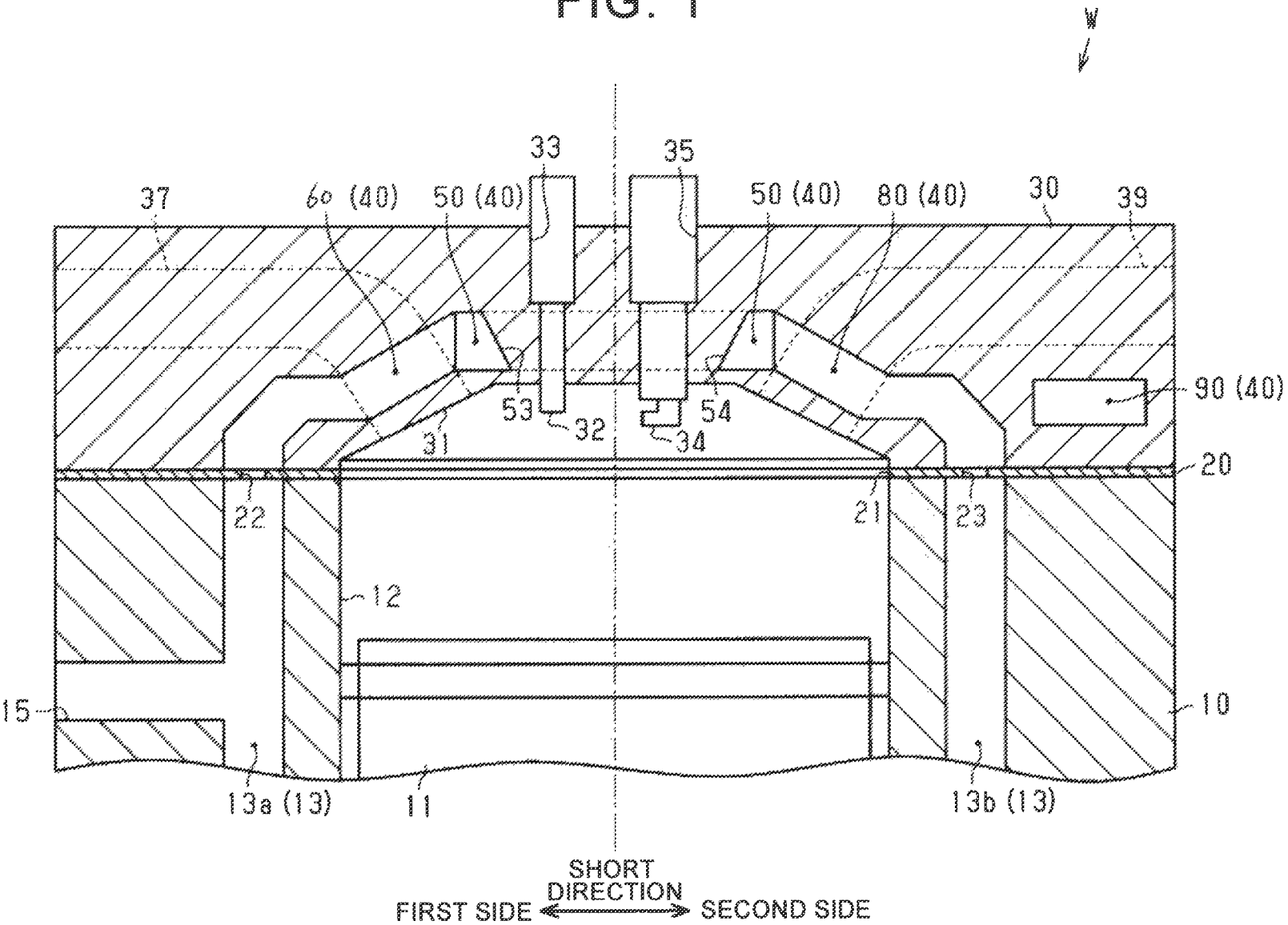
FIG. 1 is a sectional view schematically illustrating a cylinder block and a cylinder head.

The following describes one embodiment of a cylinder head with reference to the drawings. Note that the present embodiment deals with a cylinder head of an inline four-cylinder internal combustion engine as an example. As illustrated in FIG. 1, an internal combustion engine W includes a cylinder block 10 having a generally rectangular-solid shape as a whole. A cylindrical cylinder 12 is hollowed downward from a top face of the cylinder block 10. A central axis of the cylinder 12 extends in the up-down direction. A piston 11 is accommodated inside the cylinder 12. The piston 11 reciprocates inside the cylinder 12 along the central axis direction as a fuel burns in the cylinder 12. Four cylinders 12 are arranged in line along the longitudinal direction (a direction perpendicular to the plane of paper of FIG. 1) of the cylinder block 10.

Figure 2:
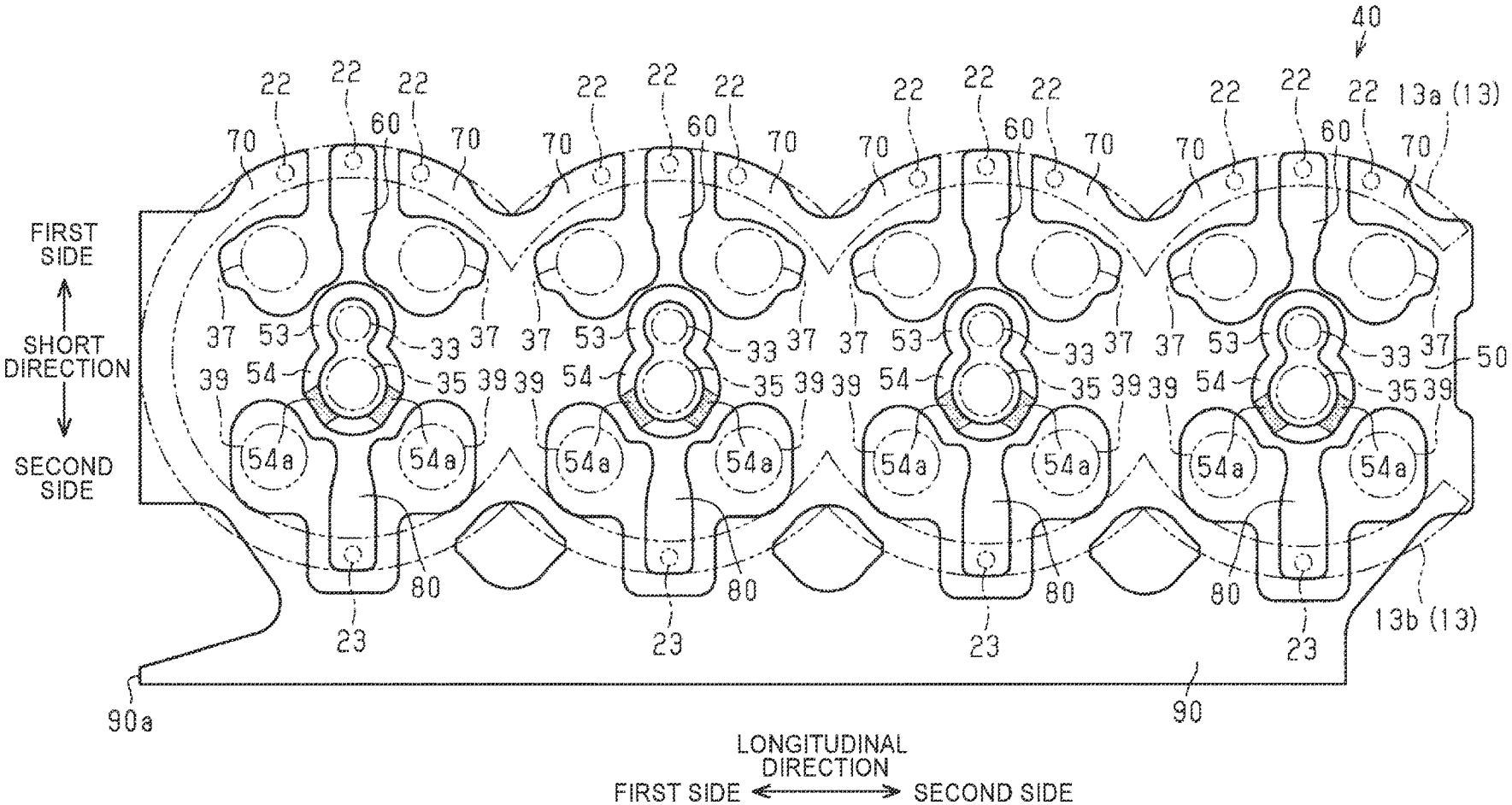
FIG. 2 is a plan view illustrating the shape of a water jacket in the cylinder head.

As illustrated in FIG. 1, a water jacket 13 through which a coolant flows is formed in the cylinder block 10. The water jacket 13 has a groove shape extending so as to surround the four cylinders 12 in the cylinder block 10. The water jacket 13 is opened on the top face of the cylinder block 10. More specifically, as illustrated in FIG. 2, the water jacket 13 includes a first block passage portion 13*a* provided on a first side in the short direction of the cylinder block 10 (a direction perpendicular to the arrangement direction of the cylinders 12). In a plan view from the upper side, the first block passage portion 13*a* extends in the longitudinal direction of the cylinder block 10, and more specifically, the first block passage portion 13*a* extends in a wave shape along the circumferential shapes of the four cylinders 12. Further, the water jacket 13 includes a second block passage portion 13*b* provided on a second side in the short direction of the cylinder block 10. In the plan view from the upper side, the second block passage portion 13*b* extends in the longitudinal direction of the cylinder block 10 as a whole. More specifically, the second block passage portion 13*b* extends in a wave shape along the circumferential shapes of the four cylinders 12. The first block passage portion 13*a* and the second block passage portion 13*b* are connected to each other on a first side (the left side in FIG. 2) in the longitudinal direction of the cylinder block 10.

As illustrated in FIG. 1, a block through-hole 15 extends from a side face on the first side in the short direction of the cylinder block 10 (the first block passage portion 13*a* side) toward the first block passage portion 13*a*. The outside of the cylinder block 10 communicates with the inside of the water jacket 13 (the first block passage portion 13*a*) via the block through-hole 15. Note that, in the present embodiment, the block through-hole 15 serves as an inlet of the coolant to the water jacket 13 in the cylinder block 10.

As illustrated in FIG. 1, a gasket 20 having a rectangular plate shape as a whole is placed on the top face of the cylinder block 10. A large through-hole 21 penetrates through the gasket 20 in its thickness direction. The large through-hole 21 has the same diameter as the cylinder 12. Further, a first through-hole 22 penetrates through the gasket 20 in its thickness direction. Three first through-holes 22 are provided for each cylinder 12 (for one cylinder 12) on a first side in the short direction of the gasket 20 from the large through-hole 21. The three first through-holes 22 are placed along the extending direction of the first block passage portion 13*a*. Further, a second through-hole 23 penetrates through the gasket 20 in its thickness direction. One second through-hole 23 is provided for each cylinder 12 on a second side in the short direction of the gasket 20 from the large through-hole 21. In a state where the gasket 20 is placed on the top face of the cylinder block 10, the large through-hole 21 of the gasket 20 is placed right above the cylinder 12 in the cylinder block 10. Further, the first through-holes 22 of the gasket 20 are placed above the first block passage portion 13*a* in the cylinder block 10. Further, the second through-hole 23 of the gasket 20 is placed above the second block passage portion 13*b* in the cylinder block 10. That is, an opening of the cylinder 12 and an opening of the water jacket 13 on the top face of the cylinder block 10 are not closed by the gasket 20.

A cylinder head body 30 (hereafter, referred to as a cylinder head) is placed on the top face of the gasket 20. The cylinder head 30 has a generally rectangular-solid shape as a whole. A combustion chamber 31 is hollowed upward from a bottom face of the cylinder head 30. The combustion chamber 31 has a tapered shape having a diameter increasing toward the lower side. The combustion chamber 31 is provided for each cylinder 12. The combustion chambers 31 are arranged in the longitudinal direction of the cylinder head 30 and are placed so as to face respective cylinders 12 in the cylinder block 10. The central axis of each of the combustion chambers 31 coincides with the central axis of its corresponding cylinder 12.

An injection valve hole 33 penetrates through the cylinder head 30 generally in the up-down direction above the combustion chamber 31. The injection valve hole 33 has a stepped shape and is configured such that the inside diameter of an upper part is larger than the inside diameter of a lower part. The injection valve hole 33 is placed near the central axis of the combustion chamber 31. More specifically, the injection valve hole 33 is placed on a first side (the first block passage portion 13*a* side) in the short direction of the cylinder head 30 from the central axis of the combustion chamber 31. The injection valve hole 33 is provided for each combustion chamber 31.

A fuel injection valve 32 configured to inject a fuel into the combustion chamber 31 is passed through the injection valve hole 33. The fuel injection valve 32 has a stepped shaft shape fitting the shape of an inner peripheral surface of the injection valve hole 33. A part of a lower distal end of the fuel injection valve 32 is exposed inside the combustion chamber 31.

A plug hole 35 penetrates through the cylinder head 30 generally in the up-down direction above the combustion chamber 31. The plug hole 35 has a stepped shape and is configured such that the inside diameter of an upper part is larger than the inside diameter of a lower part. Further, the inside diameter of the upper part of the plug hole 35 is larger than the inside diameter of the upper part of the injection valve hole 33. The inside diameter of the lower part of the plug hole 35 is larger than the inside diameter of the lower part of the injection valve hole 33. The plug hole 35 is placed near the central axis of the combustion chamber 31. More specifically, the plug hole 35 is placed on a second side (the second block passage portion 13*b* side) in the short direction of the cylinder head 30 from the central axis of the combustion chamber 31. The plug hole 35 is provided so as to be adjacent to the injection valve hole 33 in the short direction of the cylinder head 30. The plug hole 35 is provided for each combustion chamber 31.

An ignition plug 34 configured to ignite an air-fuel mixture of an air and a fuel in the combustion chamber 31 is passed through the plug hole 35. The ignition plug 34 has a stepped shaft shape fitting the shape of an inner peripheral surface of the plug hole 35. A part of a lower distal end of the ignition plug 34 is exposed inside the combustion chamber 31.

In the cylinder head 30, an intake port 37 via which an external air is introduced into the combustion chamber 31 extends from the upper side of the combustion chamber 31. The intake port 37 continues from the combustion chamber 31 to a side face of the cylinder head 30 on the first side (the first block passage portion 13*a* side) in the short direction. As illustrated in FIG. 2, two intake ports 37 are provided for each combustion chamber 31. The two intake ports 37 of the combustion chamber 31 are placed on the first side in the short direction of the cylinder head 30 from the injection valve hole 33. The two intake ports 37 of the combustion chamber 31 are arranged in the longitudinal direction of the cylinder head 30.

As illustrated in FIG. 1, in the cylinder head 30, an exhaust port 39 via which an exhaust gas is discharged from the combustion chamber 31 extends from the upper side of the combustion chamber 31. The exhaust port 39 continues from the combustion chamber 31 to a side face of the cylinder head 30 on the second side (the second block passage portion 13*b* side) in the short direction. As illustrated in FIG. 2, two exhaust ports 39 are provided for each combustion chamber 31. The two exhaust ports 39 of the combustion chamber 31 are placed on the second side in the short direction of the cylinder head 30 from the plug hole 35. The two exhaust ports 39 of the combustion chamber 31 are arranged in the longitudinal direction of the cylinder head 30 and placed at a position facing the two intake ports 37 of the combustion chamber 31 across the plug hole 35 and the injection valve hole 33. As a result, the two intake ports 37 and the two exhaust ports 39 of the combustion chamber 31 are placed so as to surround the plug hole 35 and the injection valve hole 33 in a plan view from the upper side.

A water jacket 40 as a passage through which a coolant flows is formed in the cylinder head 30. As illustrated in FIG. 2, a part of the water jacket 40 serves as an intake-port-to-intake-port passage portion 60 extending between the two intake ports 37 of the combustion chamber 31. As illustrated in FIG. 1, a bottom end (an upstream end) of the intake-port-to-intake-port passage portion 60 is opened on the bottom face of the cylinder head 30 on the first side in the short direction of the cylinder head 30 from the combustion chamber 31. The intake-port-to-intake-port passage portion 60 extends diagonally upward toward the central side in the short direction of the cylinder head 30 from the bottom face of the cylinder head 30 and reaches the vicinity of the injection valve hole 33 through between the two intake ports 37 of the combustion chamber 31. Note that, in a state where the cylinder head 30 is placed on the top face of the gasket 20, the bottom end of the intake-port-to-intake-port passage portion 60 is placed so as to face its corresponding first through-hole 22 of the gasket 20.

As illustrated in FIG. 2, the intake-port-to-intake-port passage portion 60 has a generally uniform passage sectional area from the bottom end to a central part thereof in the extending direction. In the meantime, the passage sectional area of the intake-port-to-intake-port passage portion 60 gradually decreases toward the upper end side from the central part thereof to an upper end (a downstream end) thereof in the extending direction. The intake-port-to-intake-port passage portion 60 has a minimum passage sectional area in the upper end.

A part of the water jacket 40 serves as a pair of intake-side passage portions 70 provided for each combustion chamber 31. One of the intake-side passage portions 70 is placed on a first side in the longitudinal direction of the cylinder head 30 from the intake-port-to-intake-port passage portion 60, and the other one of the intake-side passage portions 70 is placed on a second side in the longitudinal direction of the cylinder head 30 from the intake-port-to-intake-port passage portion 60. Although not illustrated herein, bottom ends (upstream ends) of the intake-side passage portions 70 are opened on the bottom face of the cylinder head 30. The intake-side passage portions 70 extend upward from the bottom face of the cylinder head 30 and upper ends of the intake-side passage portions 70 are placed at generally the same height as the upper end of the intake-port-to-intake-port passage portion 60. Further, the intake-side passage portions 70 extend so as to be distanced from the intake-port-to-intake-port passage portion 60 as they come close to the central side in the short direction of the cylinder head 30 in the plan view from the upper side. In other words, each of the intake-side passage portions 70 extends in a curved manner so as to surround its corresponding intake port 37. In the present embodiment, the passage sectional area of the upper end of the intake-side passage portion 70 is smaller than the passage sectional areas of other parts thereof. Note that, in a state where the cylinder head 30 is placed on the top face of the gasket 20, the bottom end (the upstream end) of each of the intake-side passage portions 70 is placed so as to face its corresponding first through-hole 22 of the gasket 20.

A part of the water jacket 40 serves as an exhaust-port-to-exhaust-port passage portion 80 extending between the two exhaust ports 39 of the combustion chamber 31. As illustrated in FIG. 1, a bottom end (an upstream end) of the exhaust-port-to-exhaust-port passage portion 80 is opened on the bottom face of the cylinder head 30, on the second side of in the short direction the cylinder head 30 from the combustion chamber 31. The exhaust-port-to-exhaust-port passage portion 80 extends diagonally upward toward the central side in the short direction of the cylinder head 30 from the bottom face of the cylinder head 30 and reaches the vicinity of the plug hole 35 through between the two exhaust ports 39 of the combustion chamber 31. Note that, in a state where the cylinder head 30 is placed on the top face of the gasket 20, the bottom end of the exhaust-port-to-exhaust-port passage portion 80 is placed so as to face the second through-hole 23 of the gasket 20.

As illustrated in FIG. 2, the exhaust-port-to-exhaust-port passage portion 80 has a generally uniform passage sectional area from the bottom end to a central part thereof in the extending direction. In the meantime, the passage sectional area of the exhaust-port-to-exhaust-port passage portion 80 gradually decreases toward the upper end side from the central part thereof to an upper end (a downstream end) thereof in the extending direction. The exhaust-port-to-exhaust-port passage portion 80 has a minimum passage sectional area in the upper end.

As illustrated in FIGS. 1 and 2, a part of the water jacket 40 serves as a central passage portion 50 extending continuously in the longitudinal direction of the cylinder head 30 above the four combustion chambers 31. Since the central passage portion 50 extends continuously in the longitudinal direction, the central passage portion 50 is accordingly formed so as to surround the injection valve hole 33 and the plug hole for each combustion chamber 31. Further, the upper end of the intake-port-to-intake-port passage portion 60, the upper end of the intake-side passage portion 70, and the upper end of the exhaust-port-to-exhaust-port passage portion 80 are connected to the central passage portion 50.

As illustrated in FIGS. 1 and 2, a part of the water jacket 40 serves as a discharge passage portion 90 placed on the second side in the short direction of the cylinder head 30 from the central passage portion 50. The discharge passage portion 90 extends in the longitudinal direction of the cylinder head 30 with generally the same dimension as the dimension of the central passage portion 50 in the longitudinal direction of the cylinder head 30. An end of the discharge passage portion 90 on the first side in the longitudinal direction of the cylinder head 30 serves as an outlet portion 90*a* that communicates with the outside of the cylinder head 30. The discharge passage portion 90 is connected to the central passage portion 50 in the short direction of the cylinder head 30 at a part between the exhaust port 39 of one of adjacent combustion chambers 31 and the exhaust port 39 of the other one of the adjacent combustion chambers 31. Note that the discharge passage portion 90 is placed so as to be lowered toward the second side in the short direction of the cylinder head 30 and generally the whole discharge passage portion 90 is placed at a position lower than the central passage portion 50.

Figure 3:
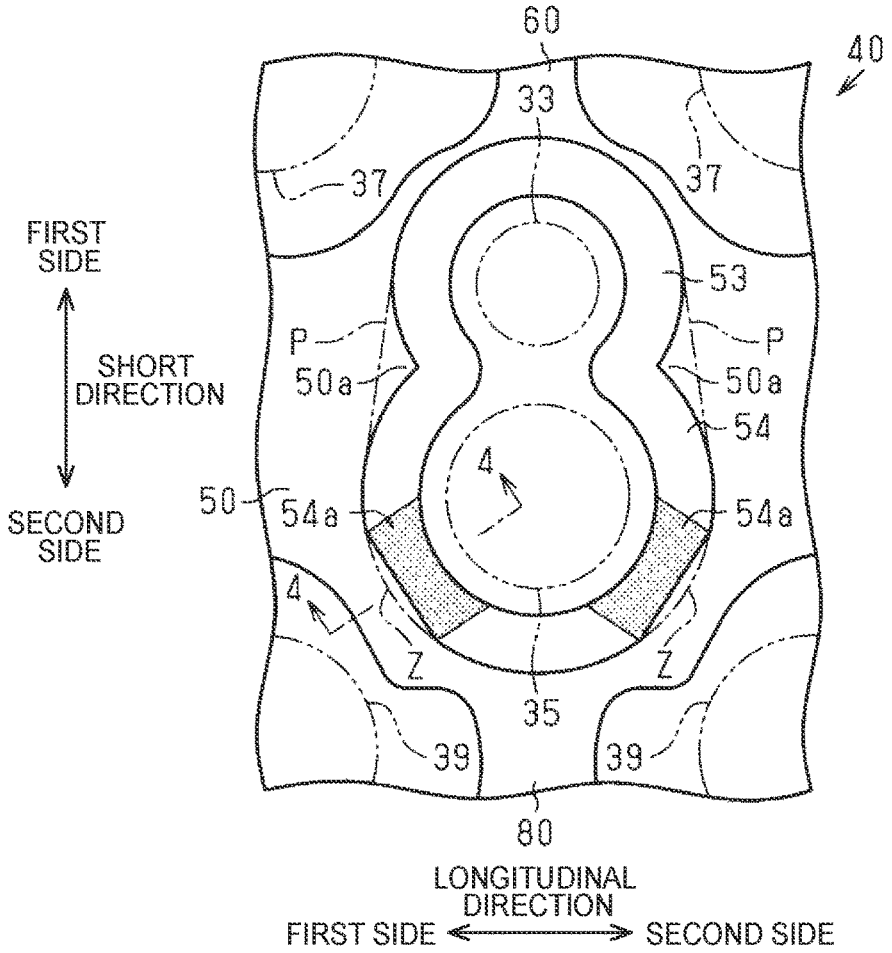
FIG. 3 is an enlarged view of a part of FIG. 2.

As illustrated in FIG. 3, in an inner surface of the central passage portion 50, a first inner peripheral surface 53 as a part extending in the circumferential direction of the injection valve hole 33 around the injection valve hole 33 is an arcuate curved surface around the central axis of the injection valve hole 33. The first inner peripheral surface 53 continues over a predetermined range in the circumferential direction around the central axis of the injection valve hole 33 so as to surround the injection valve hole 33 from the side where the two intake ports 37 of the combustion chamber 31 are provided.

As illustrated in FIGS. 1 and 3, the first inner peripheral surface 53 has a tapered shape having an inside diameter increasing toward the upper side. The taper angle of the first inner peripheral surface 53 is determined so that a distance equal to or more than a distance from a lower ledge of the first inner peripheral surface 53 to the injection valve hole 33 is secured as a distance from an upper edge of the first inner peripheral surface 53 to the injection valve hole 33. In other words, since the inside diameter of the upper part of the injection valve hole 33 is larger than the inside diameter of the lower part of the injection valve hole 33 as described above, the first inner peripheral surface 53 has a tapered shape so as to escape radially outwardly along the part with the large inside diameter.

As illustrated in FIG. 3, in the inner surface of the central passage portion 50, a second inner peripheral surface 54 that is a part extending in the circumferential direction of the plug hole 35 around the plug hole 35 is an arcuate curved surface as a whole around the central axis of the plug hole 35. The second inner peripheral surface 54 continues over a predetermined range in the circumferential direction around the central axis of the plug hole 35 so as to surround the plug hole 35 from the side where the two exhaust ports 39 of the combustion chamber 31 are provided. The opposite ends of the circular arc of the second inner peripheral surface 54 are placed between the plug hole 35 and the injection valve hole 33 in the short direction of the cylinder head 30 so as to be connected to the opposite ends of the circular arc of the first inner peripheral surface 53.

As illustrated in FIGS. 1 and 3, the second inner peripheral surface 54 has a tapered shape having an inside diameter increasing toward the upper side. The taper angle of the second inner peripheral surface 54 is determined so that a distance equal to or more than a distance from a lower ledge of the second inner peripheral surface 54 to the plug hole 35 is secured as a distance from an upper edge of the second inner peripheral surface 54 to the plug hole 35. In other words, since the inside diameter of the upper part of the plug hole 35 is larger than the inside diameter of the lower part of the plug hole 35 as described above, the second inner peripheral surface 54 has a tapered shape so as to escape radially outwardly along the part with the large inside diameter.

Figure 4:
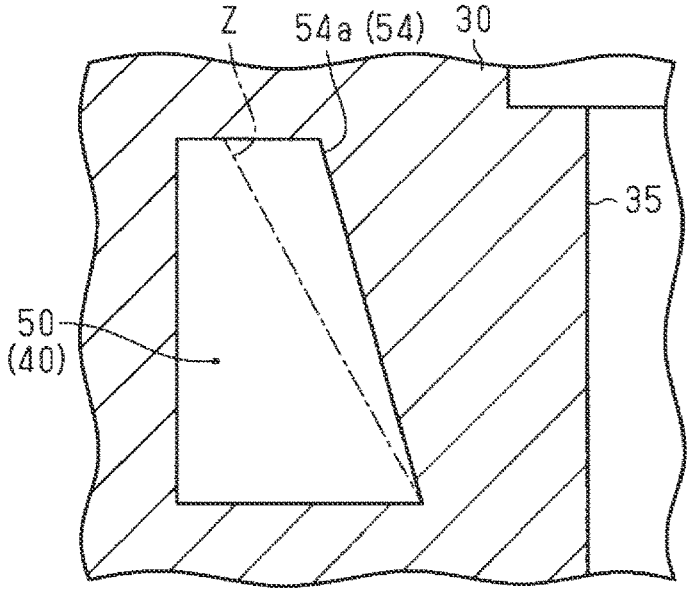
FIG. 4 is a sectional view of the cylinder head taken along an arrow 4-4 in FIG. 3.

As illustrated in FIG. 3, the second inner peripheral surface 54 is configured such that a part between the plug hole 35 and each of the two exhaust ports 39 of the combustion chamber 31 serves as an overhanging surface 54*a*. The overhanging surface 54*a* is a flat surface overhanging toward the plug hole 35 side from a curved surface part of the second inner peripheral surface 54. As illustrated in FIGS. 3 and 4, the overhanging surface 54*a* overhangs toward the plug hole 35 side from a virtual second inner peripheral surface Z obtained when the whole second inner peripheral surface 54 is formed as an arcuate curved surface around the central axis of the plug hole 35. Further, as illustrated in FIG. 4, an overhanging degree of the overhanging surface 54*a* toward the plug hole 35 side is larger toward the upper side. Note that, in FIGS. 2, 3, and 5, the overhanging surface 54*a* is indicated by dots.

As illustrated in FIG. 3, the vicinities of parts, in the central passage portion 50, where the opposite ends of the circular arc of the first inner peripheral surface 53 are connected to the opposite ends of the circular arc of the second inner peripheral surface 54 serve as projecting portions 50*a* projecting toward a region between the injection valve hole 33 and the plug hole 35. That is, the central passage portion 50 includes the projecting portion 50*a* as a part projecting inwardly from a common tangent P of the first inner peripheral surface 53 having an arcuate shape and the second inner peripheral surface 54 having an arcuate shape, when the central passage portion 50 is viewed planarly from the upper side. As a result, the first inner peripheral surface 53 and the second inner peripheral surface 54 have a shape of the Arabic numeral "8" as a whole, when they are viewed planarly from the upper side.

Next will be described the action of the present embodiment. In the present embodiment, the coolant is introduced into the block through-hole 15 of the cylinder block 10. The coolant flows into the water jacket 13 of the cylinder block 10 from the block through-hole 15 of the cylinder block 10 and circulates throughout the water jacket 13. Further, the coolant flows into the water jacket 40 of the cylinder head 30 from the water jacket 13 of the cylinder block 10. More specifically, the coolant flows into the water jacket 40 of the cylinder head 30 from the water jacket 13 of the cylinder block 10 through the bottom end (the upstream end) of the intake-port-to-intake-port passage portion 60, the bottom end (the upstream end) of the intake-side passage portion 70, and the bottom end (the upstream end) of the exhaust-port-to-exhaust-port passage portion 80.

Figure 5:
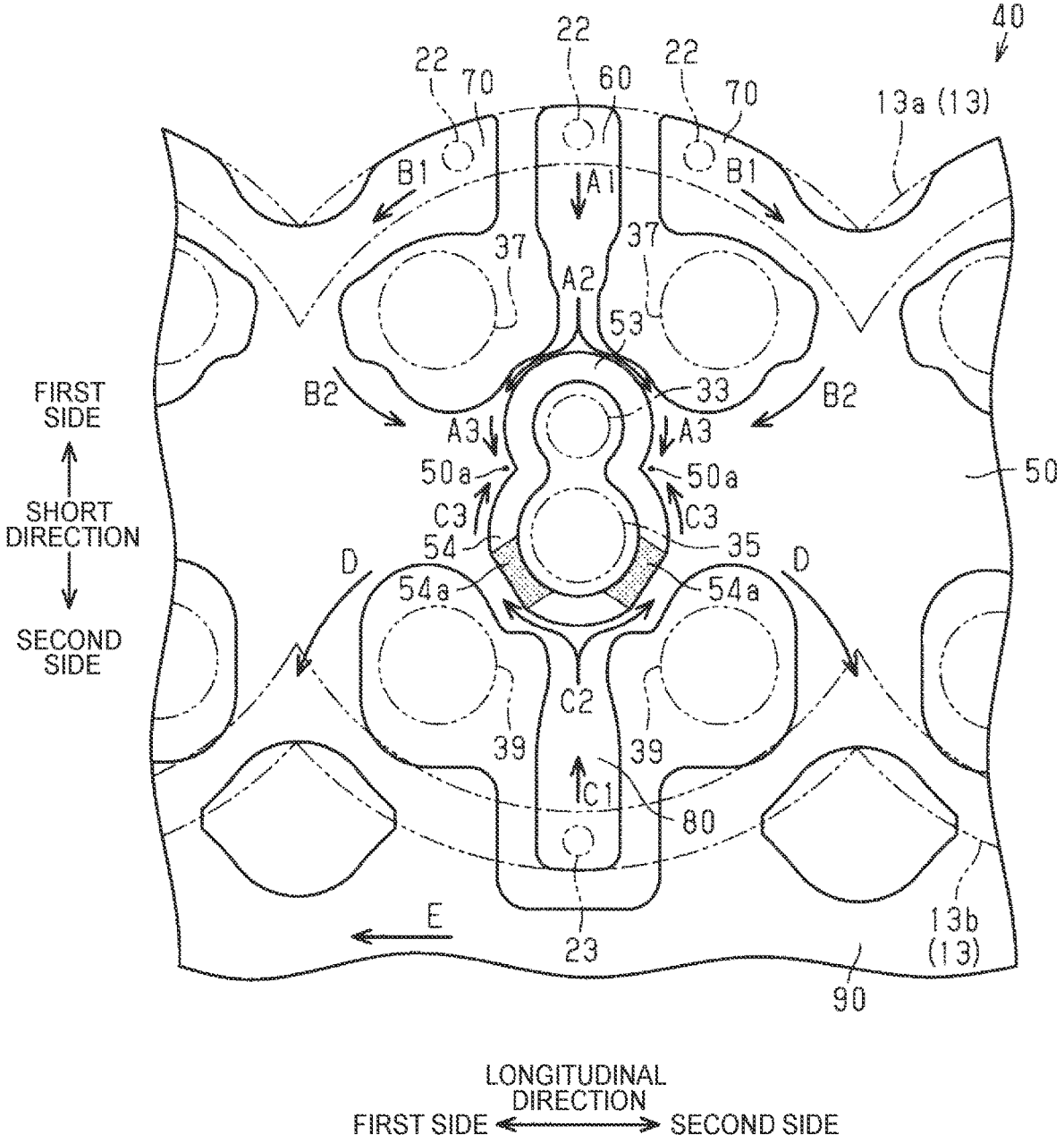
FIG. 5 is an enlarged view of a part of FIG. 2.

As indicated by an arrow A1 in FIG. 5, the coolant flowing into the water jacket 40 through the bottom end of the intake-port-to-intake-port passage portion 60 flows toward the upper end side of the intake-port-to-intake-port passage portion 60 in the short direction of the cylinder head 30 along the intake-port-to-intake-port passage portion 60. The coolant then flows from the intake-port-to-intake-port passage portion 60 into the central passage portion 50. The coolant flowing into the central passage portion 50 is branched into two ways in the longitudinal direction of the cylinder head 30 as indicated by an arrow A2 of FIG. 5. More specifically, the coolant flows between each of the two intake ports 37 of the combustion chamber 31 and the injection valve hole 33 and flows through the opposite sides of the injection valve hole 33 in the longitudinal direction of the cylinder head 30 toward the side where the exhaust ports 39 are provided. As indicated by arrows A3 in FIG. 5, a part of the coolant flows in the circumferential direction of the injection valve hole 33 along the first inner peripheral surface 53 in the central passage portion 50. The coolant also flows into the projecting portions 50*a* projecting toward the region between the plug hole 35 and the injection valve hole 33 in the central passage portion 50. As such, the coolant flows around the injection valve hole 33 in the circumferential direction of the injection valve hole 33 so as to round the injection valve hole 33.

As indicated by an arrow B1 in FIG. 5, the coolant flowing into the water jacket 40 through the bottom end of the intake-side passage portion 70 flows toward the central passage portion 50 along the intake-side passage portion 70. The coolant then flows into the central passage portion 50. As indicated by an arrow B2 in FIG. 5, a part of the coolant flowing into the central passage portion 50 flows toward the injection valve hole 33 and the plug hole 35. That is, the coolant flows around the intake port 37 in the circumferential direction of the intake port 37 so as to round the intake port 37.

As indicated by an arrow C1 in FIG. 5, the coolant flowing into the water jacket 40 through the bottom end of the exhaust-port-to-exhaust-port passage portion 80 flows toward the upper end side of the exhaust-port-to-exhaust-port passage portion 80 in the short direction of the cylinder head 30 along the exhaust-port-to-exhaust-port passage portion 80. The coolant then flows from the exhaust-port-to-exhaust-port passage portion 80 into the central passage portion 50. The coolant flowing into the central passage portion 50 is branched into two ways in the longitudinal direction of the cylinder head 30 as indicated by an arrow C2 of FIG. 5. More specifically, the coolant flows between each of the two exhaust ports 39 of the combustion chamber 31 and the plug hole 35 and flows through the opposite sides of the plug hole 35 in the longitudinal direction of the cylinder head 30 toward the side where the intake ports 37 are provided. As indicated by arrows C3 in FIG. 5, a part of the coolant flows in the circumferential direction of the plug hole 35 along the second inner peripheral surface 54 in the central passage portion 50. The coolant also flows into the projecting portions 50*a* projecting toward the region between the plug hole 35 and the injection valve hole 33 in the central passage portion 50. As such, the coolant flows around the plug hole 35 in the circumferential direction of the plug hole 35 so as to round the plug hole 35.

The coolant flowing into the central passage portion 50 through the intake-port-to-intake-port passage portion 60, the intake-side passage portion 70, and the exhaust-port-to-exhaust-port passage portion 80 flows into the discharge passage portion 90 through between the exhaust port 39 of one of adjacent combustion chambers 31 and the exhaust port 39 of the other one of the adjacent combustion chambers 31 as indicated by an arrow D in FIG. 5. As indicated by an arrow E in FIG. 5, the coolant in the discharge passage portion 90 flows toward the first side in the longitudinal direction of the cylinder head 30 so as to be directed to the outlet portion 90*a*. The coolant then flows out of the cylinder head 30 from the outlet portion 90*a*.

Next will be described the effect of the present embodiment. (1) With the present embodiment, the coolant can flow in the circumferential direction of the injection valve hole 33 so as to round the injection valve hole 33 from the side where the two intake ports 37 of the combustion chamber 31 are provided. Further, the coolant can flow in the circumferential direction of the plug hole 35 so as to round the plug hole 35 from the side where the two exhaust ports 39 of the combustion chamber 31 are provided. That is, the coolant can flow around the plug hole 35 and the injection valve hole 33 from the opposite sides in the short direction of the cylinder head 30. Accordingly, the coolant can flow over the whole region around the plug hole 35 and the injection valve hole 33 without any deviation. Accordingly, it is possible to restrain deviation in the cooling effect by the coolant around the plug hole 35 and the injection valve hole 33.

(2) In the present embodiment, the intake-port-to-intake-port passage portion 60 has a minimum passage sectional area in the upper end thereof (the end connected to the central passage portion 50). Accordingly, the coolant can flow from the intake-port-to-intake-port passage portion 60 into the central passage portion 50 vigorously. If the coolant flows weakly, the coolant may be gradually warmed by heat of the cylinder head 30 while the coolant is flowing around the injection valve hole 33 and the plug hole 35. In this regard, as described in the present embodiment, when the coolant flows vigorously, the coolant can flow around the injection valve hole 33 and the plug hole 35 while the coolant is kept at a low temperature. This accordingly makes it possible to promote cooling around the injection valve hole 33 and the plug hole 35. Further, in the present embodiment, the exhaust-port-to-exhaust-port passage portion 80 has a minimum passage sectional area in the upper end thereof (the end connected to the central passage portion 50). Accordingly, similarly to the intake-port-to-intake-port passage portion 60, the coolant can flow from the exhaust-port-to-exhaust-port passage portion 80 into the central passage portion 50 vigorously, thereby making it possible to promote cooling around the injection valve hole 33 and the plug hole 35.

(3) In a case where the distance between the plug hole 35 and the injection valve hole 33 is very short like the present embodiment, it is difficult to form a water jacket across the region between the plug hole 35 and the injection valve hole 33. In this case, the region between the plug hole 35 and the injection valve hole 33 cannot be cooled, so that the region therebetween is easily filled with heat.

In this regard, the central passage portion 50 in the present embodiment includes the projecting portions 50*a* projecting toward the region between the plug hole 35 and the injection valve hole 33. Accordingly, even in a case where the distance between the plug hole 35 and the injection valve hole 33 is very short, the region around the plug hole 35 can be cooled from the injection valve hole 33 side. Also, the region around the injection valve hole 33 can be cooled from the plug hole 35 side. Accordingly, it is possible to restrain the region between the plug hole 35 and the injection valve hole 33 from being filled with heat.

(4) The air-fuel mixture burned in the combustion chamber 31 flows into the exhaust port 39 as an exhaust gas. Accordingly, the temperature of the exhaust port 39 is higher than the intake port 37, for example. In order to restrain heat of the exhaust port 39 from reaching the plug hole 35 side, it is preferable that the passage sectional area, of the central passage portion 50, between the plug hole 35 and the exhaust port 39 be made as large as possible. Here, in the present embodiment, the plug hole 35 and the injection valve hole 33 are arranged in the short direction of the cylinder head 30 in a limited region between the two intake ports 37 and the two exhaust ports 39 of the combustion chamber 31, and the plug hole 35 is placed near the exhaust ports 39. Accordingly, in comparison with a case where only the plug hole 35 is provided between the two intake ports 37 and the two exhaust ports 39 of the combustion chamber 31, for example, the distance between the plug hole 35 and the exhaust port 39 tends to be short, so that it is difficult to secure a passage sectional area of a part of the central passage portion 50 between the plug hole 35 and the exhaust port 39. Particularly, in the present embodiment, the diameter of the plug hole 35 is larger than the diameter of the injection valve hole 33. Accordingly, in comparison with a case where the diameter of the plug hole 35 is as small as the diameter of the injection valve hole 33, for example, the distance between the plug hole 35 and the exhaust ports 39 tends to be short, so that it is difficult to secure a passage sectional area of the part of the central passage portion 50 between the plug hole 35 and the exhaust port 39.

In this regard, in the present embodiment, while the second inner peripheral surface 54 in the central passage portion 50 extends in the circumferential direction of the plug hole 35 as a whole, the overhanging surface 54*a*, of the second inner peripheral surface 54, that is a part positioned between the plug hole 35 and the exhaust port 39 overhangs toward the plug hole 35 side. That is, in a part, of the central passage portion 50, where the overhanging surface 54*a* is formed, the passage expands toward the plug hole 35 side. Accordingly, the passage sectional area, of the central passage portion 50, between the plug hole 35 and the exhaust port 39 can be made as large as possible.

(5) In the present embodiment, generally the whole region of the intake port 37 in the circumferential direction is surrounded by the intake-port-to-intake-port passage portion 60, the intake-side passage portion 70, and the central passage portion 50. Accordingly, the coolant can flow over the whole region around the intake port 37 without any deviation. Accordingly, it is possible to restrain deviation in the cooling effect by the coolant around the intake port 37.

(6) In the present embodiment, the intake-port-to-intake-port passage portion 60 and the intake-side passage portion 70 are passages independent from each other, and the coolant flows from the water jacket 13 of the cylinder block 10 into the intake-port-to-intake-port passage portion 60 and the intake-side passage portion 70 separately. Accordingly, the coolant can flow vigorously into the intake-port-to-intake-port passage portion 60 and into the intake-side passage portion 70, thereby making it possible to promote cooling around the intake port 37.

(7) In the present embodiment, the intake-side passage portion 70 has a minimum passage sectional area in the upper end thereof (the end connected to the central passage portion 50). Accordingly, the coolant can flow vigorously from the intake-side passage portion 70 into the central passage portion 50, thereby making it possible to promote cooling around the intake port 37.

(8) In the present embodiment, generally the whole region of the exhaust port 39 in the circumferential direction is surrounded by the exhaust-port-to-exhaust-port passage portion 80, the central passage portion 50, and the discharge passage portion 90. Accordingly, the coolant can flow over the whole region around the exhaust port 39 without any deviation. Accordingly, it is possible to restrain deviation in the cooling effect by the coolant around the exhaust port 39.

The present embodiment can also be carried out by adding changes as stated below. The present embodiment and the following modifications can be carried out in combination as far as they are not technically inconsistent with each other.

—With the proviso that the overhanging surface 54*a* overhangs toward the plug hole 35 side from other parts of the second inner peripheral surface 54 and a distance of a predetermined dimension or more (a predetermined thickness or more) can be secured between the overhanging surface 54*a* and the plug hole 35 in the cylinder head 30, the shape of the overhanging surface 54*a* is modifiable appropriately. The predetermined dimension is determined as a distance that can secure a minimum strength of the cylinder head 30 between the overhanging surface 54*a* and the plug hole 35. If the above condition is satisfied, the overhanging surface 54*a* may be a curved surface projecting toward the plug hole 35 side, for example.

Either of two overhanging surfaces 54*a* provided for each combustion chamber 31 may be omitted, or both of them may be omitted. Even in this case, the second inner peripheral surface 54 surrounds the plug hole 35, so that the coolant can flow over the whole region around the plug hole 35.

The shape of the second inner peripheral surface 54 is modifiable appropriately, provided that the second inner peripheral surface 54 surrounds the plug hole 35. For example, the second inner peripheral surface 54 may have a polygonal shape in the plan view from the upper side.

The shape of the second inner peripheral surface 54 is also modifiable appropriately in terms of the up-down direction. That is, the second inner peripheral surface 54 may not have a tapered shape having an inside diameter decreasing toward the lower side. For example, the second inner peripheral surface 54 may be configured to have the same diameter over the up-down direction or may have a tapered shape having an inside diameter increasing toward the lower side. Note that a distance of a predetermined dimension or more (a predetermined thickness or more) should be secured between the plug hole 35 and the second inner peripheral surface 54 in the cylinder head 30. The predetermined dimension is determined as a distance that can secure a minimum strength of the cylinder head 30 between the plug hole 35 and the second inner peripheral surface 54.

The shape of the first inner peripheral surface 53 is modifiable appropriately, provided that the first inner peripheral surface 53 surrounds the injection valve hole 33. For example, the first inner peripheral surface 53 may have a polygonal shape in the plan view from the upper side. When the first inner peripheral surface 53 surrounds the injection valve hole 33, the coolant can flow over the whole region around the injection valve hole 33.

The shape of the first inner peripheral surface 53 is also modifiable appropriately in terms of the up-down direction. That is, the first inner peripheral surface 53 may not have a tapered shape having an inside diameter decreasing toward the lower side. The first inner peripheral surface 53 may be configured to have the same diameter over the up-down direction or may have a tapered shape having an inside diameter increasing toward the lower side. Note that a distance of a predetermined dimension or more (a predetermined thickness or more) should be secured between the injection valve hole 33 and the first inner peripheral surface 53 in the cylinder head 30. The predetermined dimension is determined as a distance that can secure a minimum strength of the cylinder head 30 between the injection valve hole 33 and the first inner peripheral surface 53.

The central passage portion 50 may be configured to cross the region between the plug hole 35 and the injection valve hole 33 depending on the distance between the plug hole 35 and the injection valve hole 33. In other words, the first inner peripheral surface 53 may surround the whole region of the injection valve hole 33 in the circumferential direction, and the second inner peripheral surface 54 may surround the whole region of the plug hole 35 in the circumferential direction.

The central passage portion 50 may not include the projecting portions 50*a* projecting toward the region between the plug hole 35 and the injection valve hole 33. For example, the central passage portion 50 may be configured such that the first inner peripheral surface 53 and the second inner peripheral surface 54 are continuous with each other so as to form an elongate hole shape as a whole in the plan view from the upper side. When the central passage portion 50 surrounds the plug hole 35 and the injection valve hole 33 as a whole, the coolant can flow over the whole region around the plug hole 35 and the injection valve hole 33.

The shape of the discharge passage portion 90 is modifiable appropriately, provided that the discharge passage portion 90 communicates with the central passage portion 50 and extends toward the outside of the cylinder head 30. For example, the discharge passage portion 90 may have a shape merging at the center in the longitudinal direction of the cylinder head 30 and extending toward the second side in the short direction of the cylinder head 30. The position of the outlet portion 90*a* of the discharge passage portion 90 is modifiable appropriately according to the shape of the discharge passage portion 90. The outlet portion 90*a* may be provided in an end on the second side in the longitudinal direction of the cylinder head 30 or may be provided in an end in the short direction of the cylinder head 30, for example.

The change of the passage sectional area of the intake-port-to-intake-port passage portion 60 in the extending direction of the intake-port-to-intake-port passage portion 60 is modifiable appropriately. For example, the passage sectional area of the intake-port-to-intake-port passage portion 60 may be minimized between the central part of the intake-port-to-intake-port passage portion 60 and the upper end thereof in the extending direction. The passage sectional area of the intake-port-to-intake-port passage portion 60 may be uniform over the whole region of the intake-port-to-intake-port passage portion 60 in the extending direction. When the intake-port-to-intake-port passage portion 60 is provided, the coolant can be introduced toward the injection valve hole 33 from the intake port 37 side. Similarly, the change of the passage sectional area of the exhaust-port-to-exhaust-port passage portion 80 in the extending direction of the exhaust-port-to-exhaust-port passage portion 80 is modifiable appropriately.

The shape of the intake-side passage portion 70 is modifiable appropriately. Even in a case where the intake-side passage portion 70 has any shape, when the intake-port-to-intake-port passage portion 60, the exhaust-port-to-exhaust-port passage portion 80, and the central passage portion 50 are provided, the coolant can flow over the whole region around the plug hole 35 and the injection valve hole 33, and the coolant can flow over a part of the region around the intake port 37 by the intake-port-to-intake-port passage portion 60 and the central passage portion 50. Incidentally, the intake-side passage portion 70 is modifiable as follows, for example. The bottom end of the intake-side passage portion 70 may be connected to the bottom end of the intake-port-to-intake-port passage portion 60. In this case, the bottom end of the intake-side passage portion 70 may not communicate with the water jacket 13 of the cylinder block 10. The intake-side passage portion 70 may be bent in an L-shape so as to surround the intake port 37. The intake-side passage portion 70 may have a shape extending in parallel to the intake-port-to-intake-port passage portion 60 on the side opposite from the intake-port-to-intake-port passage portion 60 across the intake port 37. The passage sectional area of the intake-side passage portion 70 may not be minimized in its downstream end. Further, the intake-side passage portion 70 may be omitted.

In the cylinder head 30, the shape of the plug hole 35 is modifiable appropriately with the proviso that the ignition plug 34 can pass therethrough. The plug hole 35 may be configured to have a uniform diameter over the opposite edges in the up-down direction or may have a tapered shape, for example. Similarly, the shape of the injection valve hole 33 is modifiable appropriately with the proviso that the fuel injection valve 32 can pass therethrough. Note that the plug hole 35 and the injection valve hole 33 do not necessarily have a stepped shaft shape, and their shapes may be changed appropriately. Further, the plug hole 35 and the injection valve hole 33 may extend in a direction inclined relative to the up-down direction.

In the cylinder head 30, the injection valve hole 33 and the fuel injection valve 32 may not be provided between the two intake ports 37 and the two exhaust ports 39 of the combustion chamber 31. In this case, only the plug hole 35 is provided between the two intake ports 37 and the two exhaust ports 39, and the first inner peripheral surface 53 of the central passage portion 50 is omitted.

The configuration of the cylinder block 10 is modifiable appropriately with the proviso that the cylinder block 10 includes the cylinders 12 and the water jacket 13. Note that it is necessary for the water jacket 13 to be provided in a communicable manner with the water jacket 40 of the cylinder head 30. In the cylinder block 10, the block through-hole 15 serving as the inlet of the coolant may be provided on the second block passage portion 13*b* side, for example. The second block passage portion 13*b* may communicate with the outside of the cylinder block 10 via the block through-hole 15. Further, the number of cylinders 12 may be changed. In a case where the number of cylinders 12 is changed, the number of combustion chambers 31 and the number of parts provided for the combustion chambers 31 in the cylinder head 30 are increased or decreased according to the number of cylinders 12. In terms of the water jacket 40 of the cylinder head 30, the number of passages provided for the combustion chambers 31 is increased or decreased.

What is claimed is:

1. A cylinder head comprising:

a cylinder head body including:

a plug hole penetrating through the cylinder head body, the plug hole being provided for each of a plurality of cylinders of an internal combustion engine such that an ignition plug is passed through the plug hole;

two intake ports and two exhaust ports corresponding to the plug hole, the two intake ports and the two exhaust ports being provided inside the cylinder head body such that the two intake ports are located on a first side of the cylinder head body in a short-axis direction of the cylinder head body with respect to the plug hole and the two exhaust ports are located on a second side of the cylinder head body in the short-axis direction of the cylinder head body with respect to the plug hole; and a water jacket through which a coolant circulates, the water jacket being provided inside the cylinder head body, the water jacket including:

an intake-port-to-intake-port passage communicating with an outside of the cylinder head and extending between the two intake ports;

an exhaust-port-to-exhaust-port passage communicating with the outside of the cylinder head and extending between the two exhaust ports;

a central passage communicating with the intake-port-to-intake-port passage and the exhaust-port-to-exhaust-port passage, the central passage being formed so as to surround the plug hole, the coolant flowing from the intake-port-to-intake-port passage and the exhaust-port-to-exhaust-port passage into the central passage; and a discharge passage communicating with the central passage and extending toward the outside of the cylinder head.

2. The cylinder head according to claim 1, wherein:

a passage cross-sectional area of the intake-port-to-intake-port passage portion is smallest in an end of the intake-port-to-intake-port passage on a side of the central passage; and a passage cross-sectional area of the exhaust-port-to-exhaust-port passage portion is smallest in an end of the exhaust-port-to-exhaust-port passage on a side of the central passage.

3. The cylinder head according to claim 1, wherein:

an injection valve hole in which a fuel injection valve is inserted is provided between the plug hole and the two intake ports so as to be adjacent to the plug hole;

in an inner surface of the central passage, an inner peripheral surface extending in a circumferential direction of the plug hole includes (i) an arcuate curved surface extending so as to surround the plug hole, and (ii) an overhanging surface overhanging toward a direction of the plug hole from the curved surface; and the overhanging surface is located between the plug hole and a corresponding one of the two exhaust ports.

4. The cylinder head according to claim 1, wherein:

an injection valve hole in which a fuel injection valve is inserted is provided between the plug hole and the two intake ports so as to be adjacent to the plug hole;

the central passage is provided so as to surround the plug hole and the injection valve hole; and the central passage includes a projecting portion projecting toward a region between the plug hole and the injection valve hole.

5. The cylinder head according to claim 1, wherein:

an intake-side coolant opening through which the coolant flows into the intake-port-to-intake-port passage is provided on a bottom face of the cylinder head body, the intake-side coolant opening being provided on the first side of the cylinder head body in the short-axis direction of the cylinder head body with respect to a corresponding one of the plurality of cylinders; and the intake-port-to-intake-port passage extends diagonally upward toward a central part of the cylinder head in the short-axis direction from the intake-side coolant opening.

6. The cylinder head according to claim 1, wherein:

an exhaust-side coolant opening through which the coolant flows into the exhaust-port-to-exhaust-port passage is provided on a bottom face of the cylinder block, the exhaust-side coolant opening being provided on the second side in the short-axis direction of the cylinder head with respect to a corresponding one of the plurality of cylinders; and the exhaust-port-to-exhaust-port passage extends diagonally upward toward a central part of the cylinder head in the short-axis direction with respect to the exhaust-side coolant opening.

* * * * *